United States Patent [19]

Kito

[11] 4,077,358

[45] Mar. 7, 1978

[54] DEACTIVATING DEVICE FOR A MAGNETIC BRUSH DEVELOPER USED IN A MULTICOLOR ELECTROPHOTOGRAPHIC COPYING MACHINE

[75] Inventor: Hidetoshi Kito, Ebina, Japan

[73] Assignee: Rank Xerox Ltd., London, England

[21] Appl. No.: 793,458

[22] Filed: May 3, 1977

[30] Foreign Application Priority Data

May 17, 1976 Japan ..... 51-061357

[51] Int. Cl.[2] ..... G03G 15/09; G03G 15/01

[52] U.S. Cl. ..... 118/658; 118/645

[58] Field of Search ..... 118/645, 658, 652, 653

[56] References Cited

U.S. PATENT DOCUMENTS

| | | | |
|---|---|---|---|
| 3,641,969 | 2/1972 | Hakanson | 118/658 X |
| 3,883,291 | 5/1975 | Cloutier et al. | 118/652 X |
| 3,900,003 | 8/1975 | Sato et al. | 118/645 |
| 3,947,108 | 3/1976 | Thettu et al. | 118/652 X |
| 4,030,445 | 6/1977 | Takenaga et al. | 118/645 |

*Primary Examiner*—Mervin Stein
*Assistant Examiner*—Andrew M. Falik

[57] ABSTRACT

A magnetic brush arrangement having plural magnetic rolls for applying developer material to an electrostatic latent image. One of the rolls is selectively rendered inoperative by the provision of means to remove developer from the roll while concurrently interposing a separator sheet between the inoperative roll and the latent image.

2 Claims, 5 Drawing Figures

DEACTIVATING DEVICE FOR A MAGNETIC BRUSH DEVELOPER USED IN A MULTICOLOR ELECTROPHOTOGRAPHIC COPYING MACHINE

BACKGROUND OF THE INVENTION

This invention relates to a developing device for use in an electrophotographic copying machine, and more particularly to a developing device for developing an electrostatic latent image formed on an electrostatic image support member into a multicolored toner image.

In order to develop an electrostatic latent image formed on an electrostatic image support member into a multicolored toner image according to the electrophotography, there has been proposed arrangements in which a plurality of magnetic brush developing units are disposed along the electrostatic image support member for successive or sequential development.

This type of arrangement of necessity requires that some of the developing units be held inoperative while another is carrying out image development. A problem associated with this is that developer fed to an inoperative magnetic brush developing unit may unwantedly contact the surface of the electrostatic latent image support member, resulting in the spoiling of the toner image.

To overcome the above shortcoming, two different types of developing devices have been proposed; one is such that among a plurality of developing units, developing rolls of the developing units which are in an inoperative condition are diverted or displaced from the electrostatic image support member, so as to avoid spoiling the toner image; and the other is such that a control plate for controlling a flow rate of developer is provided in each developing unit, so as to interrupt the feeding of a developer to developing rolls of the inoperative developing units, thereby preventing the toner image from being spoiled.

These developing devices, however, have been accompanied with other drawbacks. In the former, extremely close control of several process parameters is required to obtain optimum development. In addition, the control arrangement is complex in construction. In the latter, a small amount of developer remains on developing rolls of inoperative developing units, this residual developer being extremely difficult to promptly remove from the roll. Furthermore, the small amount of residual developer on the developing rolls tends to be more concentrated along the magnetic lines of force, and contact the surface of the electrostatic image support member in those areas, thus forming undesired stripes or lines on the toner image developed by the other magnetic brush developing unit, thereby spoiling the appearance of the toner image.

OBJECTS OF THE PREFERRED EMBODIMENT

It is accordingly an object of the present invention to provide a developing unit including plural developing devices for use in an electrophotographic copying machine, wherein when one developing unit is in an inoperative condition, feeding of developer to an electrostatic image via this developing roll is interrupted by removing developer from the roll by means of a developer control plate, and concurrently interposing a separator plate an electrostatic image support member and the developing roll, so as to prevent contact of a small amount of residual developer on the developing roll with the surface of the electrostatic image support member.

BRIEF DESCRIPTION OF THE DRAWINGS

The accompanying drawings show an embodiment of the present invention, wherein.

DESCRIPTION OF THE PREFERRED EMBODIMENT

Figure 2:
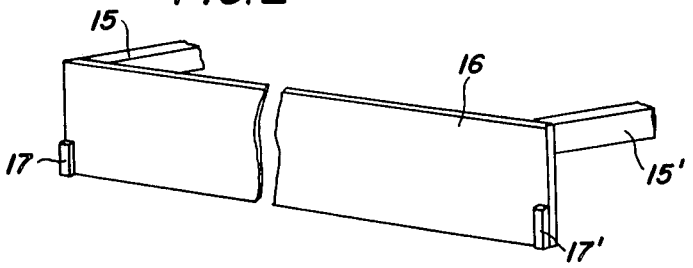
FIG. 2 is a perspective view of a separator.
Figure 3:
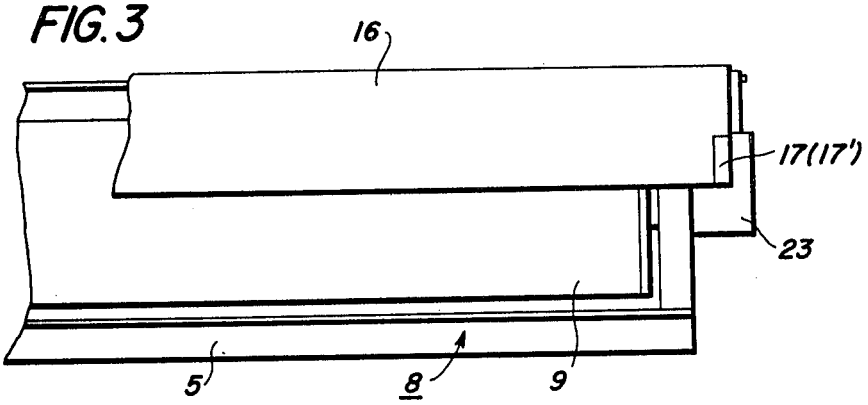
FIG. 3 is a side view of one magnetic brush developing unit as seen from the photosensitive drum 1; and, FIGS. 4 and 5 each illustrate a modified form of separator.

The preferred embodiment of the invention will now be described with reference to FIGS. 1–3 which illustrate a development arrangement comprising a plurality of magnetic brush developing units 2, 3 and 4 disposed in place around an electrostatic image support member 1, such as a photosensitive drum. The magnetic brush developing units are of identical construction. Referring to the construction of the respective magnetic brush developing units 2, 3 and 4, developer is fed from a developer receptacle area 6 located in the lower portion of a developer container 5 to the vicinity of a developing roll 8 by means of an agitator 7. The developer is then transported to a developing zone 11 by the action of transporting magnets 10 and 10' housed in a rotary sleeve 9 of the developing roll 8, and by virture of the magnetic force of a developing magnet 12, brush-like burs of developer are formed therein, for the development of an electrostatic latent image formed on the photosensitive drum 1 into a visual toner image. In the course of feeding of the developer to the developing roll, a flow rate of developer is controlled by a flow-rate regulating plate 13, so that the developer may be fed to the developing zone 11 at an optimum flow rate.

A pair of arms 15, 15' are pivotally mounted on the opposite external walls 14, 14' of respective developer container 5. Rigid with the pair of arms 15, 15' is a separator 16, which extends in the longitudinal axial direction of the developing roll 8 and is adapted to be inserted between the developing roll 8 and the photosensitive drum 1 and displaced therefrom. Provided on the opposite sides of the separator 16 are spacers 17 and 17' which are so designed as to contact the peripheral edges of the photosensitive drum 1, so as to prevent contact of the separator 16 with the peripheral surface of the photosensitive drum. Within each developer container 5, a developer-control plate 19 is rotatably mounted on a shaft 18, so that said plate may be brought into contact with or separated from the surface of the developing roll in the longitudinal axial direction of the roll. The shaft 18 extends through the side wall 14 and has at one end thereof a gear 20, which in turn is in meshing relation with another gear 22 mounted on a rotary shaft 21, on which the pair of arms are mounted. Thus, the gear 20 is rotated in response to the movement of the pair of arms 15, 15'. The developer control plate 19 is turned in association with the movement of the separator 16, so as to interrupt flow of the developer when a developing unit is in an inoperative condition.

The pivotal movement of the pair of arms 15, 15' is caused by a solenoid 23 provided on at least one of the side walls 14, 14' of respective developer container.

Figure 1:
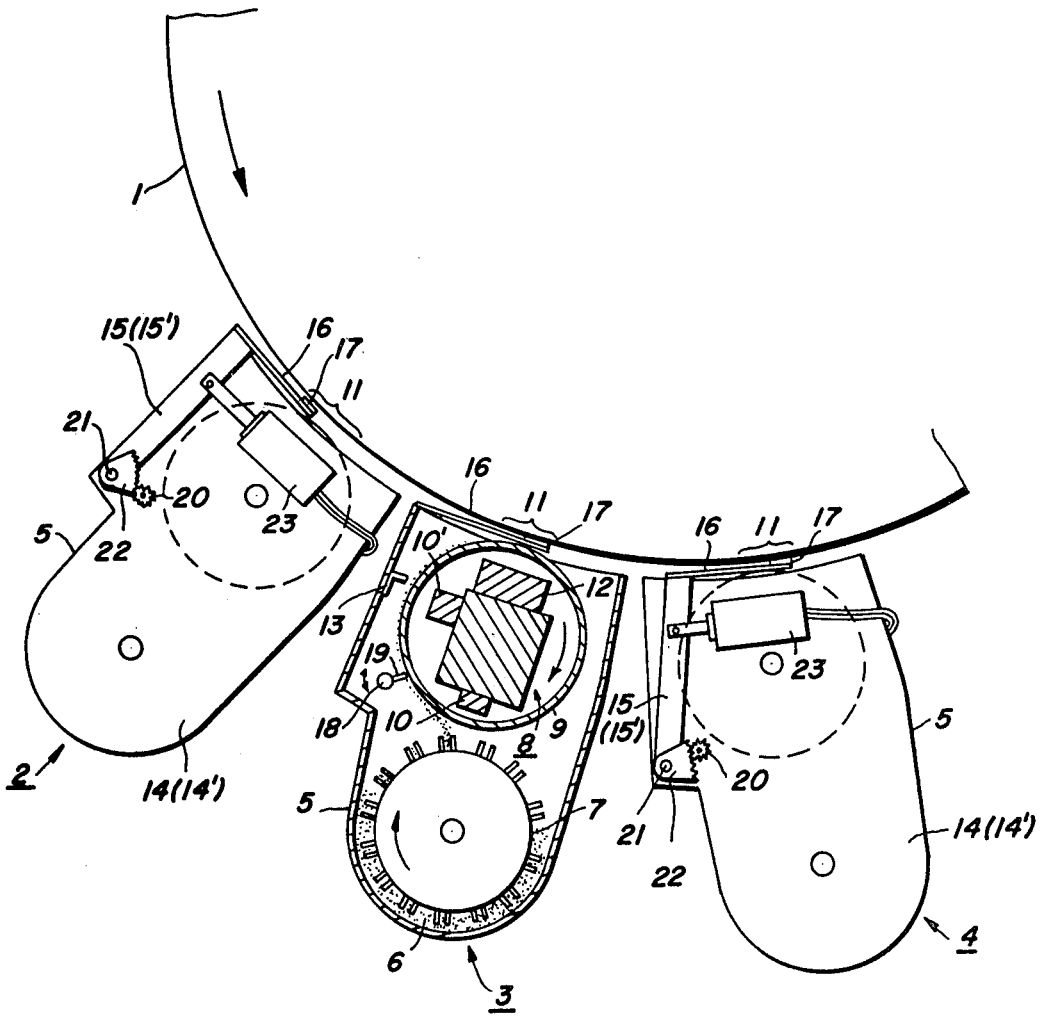
FIG. 1 is a front view of a developing device, with one magnetic brush developing unit shown in cross section.

In operation, where it is desired to obtain a multicolored copy by using the plurality of developing units 2, 3, and 4, if one of the plurality of developing units, for example, the developing unit 2 in FIG. 1, is alone in operation, then the other developing units 3 and 4 are maintained in inoperative status. At this time, the arms 15, 15' of the developing units 3 and 4, which are in an inoperative condition, are pivotally moved by actuating the solenoids 23, thereby inserting the separators 16 of these units between the photosensitive drum 1 and the developing rolls 8 of these units. At the same time, the developer control plates 19 of these units 3 and 4 are brought into contact with the peripheral surface of the developing rolls 8 thereof, to thereby interrupt the feeding of the developer to the developing zone 11. It should be noted that, in case development of a latent image into a toner image is effected sequentially in these plurality of magnetic brush developing units for giving desired different colors, the separators 16 and the developer control plates 19 of the magnetic brush developing units which are in an inoperative condition perform these functions.

Figure 4:
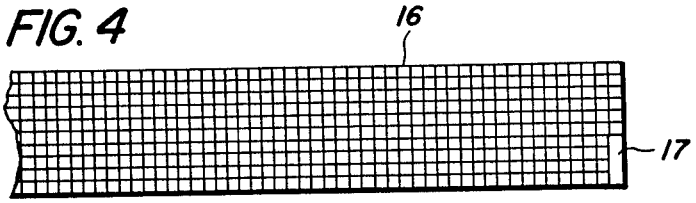
Figure 5:
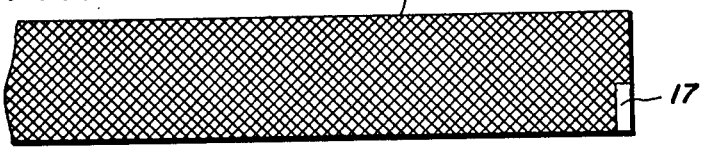

FIGS. 4 and 5 are modifications of the separator 16. The separator shown in FIGS. 1 through 3 is of a plate shaped, but may be of a lattice shape or net shape, as long as the material selected is sufficiently strong. The thickness of the separator is optional, as long as the separator is freely insertable between the photosensitive drum 1 and the developing roll 8.

In short, when one or more magnetic brush developing units are in an inoperative condition, the developer control plates 19 of the developing units in the inoperative condition are operated to interrupt feeding of the developer to the developing rolls of said developing units, and at the same time, the separators 16 of the developing units assuming the inoperative condition are inserted between the electrostatic image suport member 1 and the developing rolls 8, thereby preventing contact of a small amount of residual developer on said developing rolls with the surface of the electrostatic image support member 1.

Thus, during development of a latent image into a multicolored toner image, there is less risk of spoiling the toner image and greater assurance that the toner image will have a neat appearance.

It is thus seen that the developer control plate 19, separator 16 and associated controlling means allow the plurality of magnetic brush developing rolls to be maintained stationary, while still achieving selective control over each unit individually. This provides for simplicity in construction of the developing device, and reduces the closeness of control of system parameters previously required to produce optimum development.

What is claimed is:

1. In a developing arrangement having at least two magnetic brush developing rolls, one of which is held in an inoperative condition while the other is operated to develop the latent image, the improvement comprising, a control plate associated with each roll for removing developer material from said rolls, a separator associated with each roll and interposable between its associated roll and the latent image, and means for controlling the plate and separator of one of said rolls independently of the other whereby one roll may be rendered inoperative to develop said image independently of the other by concurrently adjusting its associated plate and separator.

2. The combination recited in claim 1 wherein said plate and separator are operated by a solenoid means.

* * * * *